United States Patent [19]

Ibuki

[11] 4,207,447

[45] Jun. 10, 1980

[54] GAS INTERRUPTER HAVING NARROW AND WIDE ARC PASSAGES

[75] Inventor: Koji Ibuki, Amagasaki, Japan

[73] Assignee: Mitsubishi Denki Kabushiki Kaisha, Tokyo, Japan

[21] Appl. No.: 889,879

[22] Filed: Mar. 24, 1978

[30] Foreign Application Priority Data

Mar. 24, 1977 [JP] Japan ..... 52-32912

[51] Int. Cl.[2] ..... H01H 33/74

[52] U.S. Cl. ..... 200/148 R; 200/148 A

[58] Field of Search ..... 200/148 R, 148 A, 148 B, 200/148 C, 148 E, 148 F, 148 G, 148 J, 148 BV, 150 D, 150 G, 149 R, 144 R

[56] References Cited

U.S. PATENT DOCUMENTS

| | | | |
|---|---|---|---|
| 3,140,374 | 8/1964 | Cole | 200/149 X |
| 3,909,572 | 9/1975 | Tsubaki et al. | 200/148 A |
| 4,032,736 | 6/1977 | Ruffieux et al. | 200/147 R |
| 4,139,752 | 2/1979 | Itai et al. | 200/148 A |

OTHER PUBLICATIONS

Japanese Utility Model Publication No. 29345/1972 to Iwamoto et al.

Japanese Utility Model Publication No. 42465/1974 to Iwamoto et al.

*Primary Examiner*—J. V. Truhe

*Assistant Examiner*—Morris Ginsburg

*Attorney, Agent, or Firm*—Oblon, Fisher, Spivak, McClelland & Maier

[57] ABSTRACT

In a gas interrupter, high pressure gas such as air and $SF_6$ is puffed to an arc so as to perform the extinction of the arc and a part of the passage of the arc is limited to narrow space and the arc voltage is raised at the narrow part and the other part of the passage of the arc is kept in wide space and the puffing rate of the high pressure gas is kept high enough at the wide space.

1 Claim, 5 Drawing Figures

GAS INTERRUPTER HAVING NARROW AND WIDE ARC PASSAGES

BACKGROUND OF THE INVENTION

1. FIELD OF THE INVENTION

The present invention relates to a gas interrupter which has improved characteristic as the gas interrupter to form an arc extinction chamber having high interrupting characteristic with low cost.

2. DESCRIPTION OF THE PRIOR ART

In general, the gas interrupter comprises contacts which are contacted with each other and means for puffing the gas to the arc formed between the contacts by departing the contacts.

FIG. 1 is a partial sectional view of an arc extinct chamber in the conventional gas interrupter.

The arc extinction chamber will be illustrated. The gas is fed through flow guides (8), (9) formed by an insulation material and is puffed as the gas flow (4) to the arc (3) formed between a movable contact (1) and a fixed contact (2).

In general, the arc voltage can be easily raised when the space (5) forming the arc in the case is narrow. However, on the contrary, in order to raise the arc voltage by the flow of the gas, the wide space for providing suitable puffing rate is needed.

That is, in order to improve the interrupting characteristic, in one hand, narrow space of the arc chamber (5) is required, whereas in the other hand, wide space of the arc chamber (5) is required. It has been difficult to satisfy both of the requirements.

SUMMARY OF THE INVENTION

The present invention provides a gas interrupter for satisfying the requirements to form the arc in a narrow space and the arc in a wide space while puffing the gas in series whereby the interrupting characteristic is improved in low cost.

The gas interrupter of the present invention comprises a movable contact and a fixed contact, an insulator covering one end of either the movable contact or the fixed contact; whereby a part of a passage of the arc is limited to narrow space by the insulator and the other insulation wall during the interrupting time so as to raise the arc voltage and wide space is formed in the other part of the passage of the arc so as to give high puffing rate of the high pressure gas. Thus, the contradictory requirements to give narrower space and wider space for the passage of the arc are satisfied.

DETAILED DESCRIPTION OF THE PREFERRED EMBODIMENTS

Figure 1:
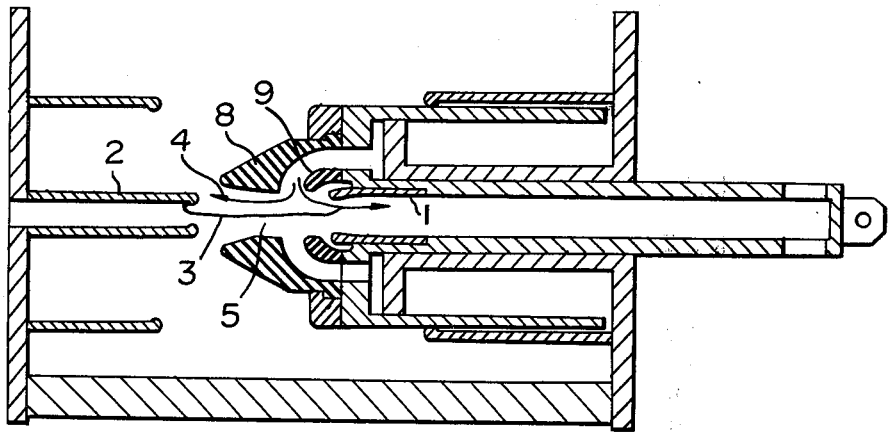
FIG. 1 PRIOR ART
FIG. 1 is a sectional view of a part of an arc extinction chamber in the conventional gas interrupter.

Referring to the drawings, the embodiment of the gas interrupter of the present invention will be illustrated.

Figure 2:
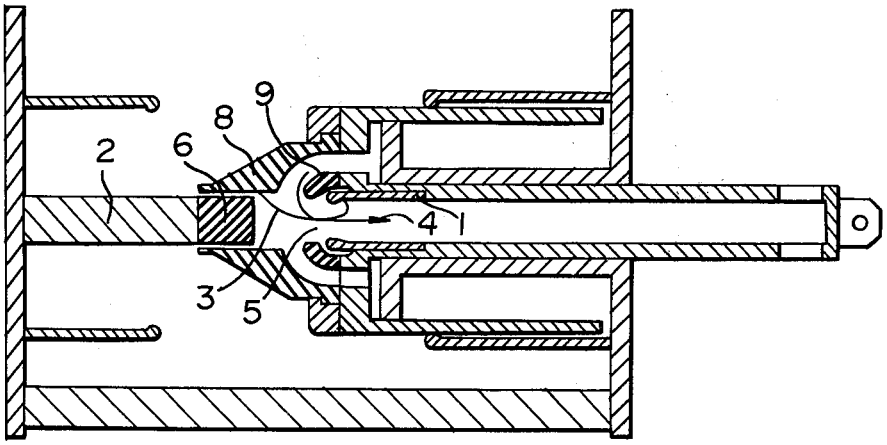
FIG. 2 is a sectional view of a part of an arc extinction chamber in one embodiment of the gas interrupter according to the present invention.

FIG. 2 is the sectional view of the embodiment of the gas interrupter of the present invention.

Figure 3A:
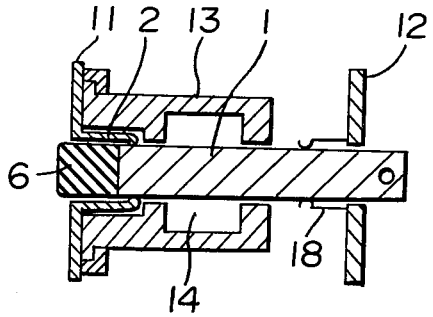
FIGS. 3(*a*) to (*c*) are respectively sectional views showing the opening and closing conditions of a movable contact and a fixed contact in the other embodiment of the gas interrupter according to the present invention.
Figure 3B:
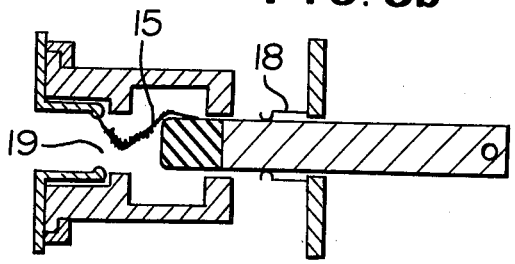
Figure 3C:
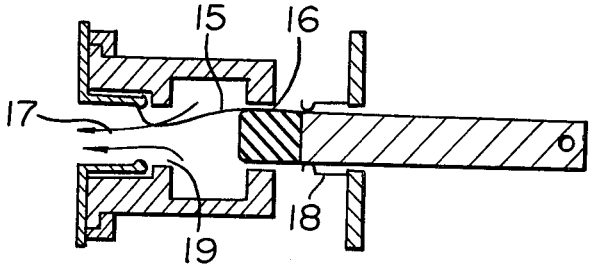

In FIG. 3, the same reference numerals designate the identical or corresponding parts in FIG. 2 and the description for such parts as are not recited and the different parts are mainly illustrated.

In the embodiment of FIG. 2, as it is clear from the drawing, an insulator such as an insulator (6) made of polytetrafluoroethylene (Teflon) etc., is mounted on the end of the fixed contact (2). The arc is formed between the movable contact (1) and the fixed contact (2) and the arc should be passed through the narrow passage formed between the insulator (6) and the flow guide (8).

The movable contact (1) is hollow and the gas flow (4) is passed through the hollow and puffed to the arc (3) and the arc is cooled as the same with those of the conventional case. In accordance with the embodiment of the present invention, the arc (3), the part for raising the arc voltage in the narrow passage and the part for puffing the gas to cool the arc are connected in series, whereby both of the requirement for puffing the gas and the requirement for narrow arc passage are satisfied respectively. Accordingly, the sizes of the arc passages can be respectively selected as desired advantageously. Accordingly, it is possible to improve the interrupting characteristics of the interrupter.

In the embodiment shown in FIG. 2, the puffer type gas interrupter is described. Thus, the present invention can be applied for the double pressure type gas interrupter.

Referring to FIGS. 3(*a*) to (*c*), the other embodiment of the gas interrupter of the present invention will be illustrated.

FIGS. 3(*a*) to (*c*) show the operating conditions of the gas interrupter and are the views of the interrupting parts of the gas interrupter. These parts are disposed in a gas container.

In FIGS. 3(*a*) to (*c*), the reference numerals (11), (12) are respectively terminals. The terminal (12) is electrically connected through the current collector (18) to the movable contact (1).

The fixed contact (2) is connected to the terminal (11) and is contacted with the movable contact (1) in the closing condition to pass the current. Thus, when the movable contact (1) is moved to the right direction by a driving device (not shown), the contact between the movable contact (1) and the fixed contact (2) is released to form the arc (15) between the fixed contact and the movable contact (1) as shown in FIG. 3(*b*). The arc current passed by the arc (15) is varied depending upon the commercial frequency. The gas in the arc chamber (14) is heated by the arc during the time of large arc current and the pressure is raised.

However, the arc (15) closes the opening part (19) formed on the fixed contact (2) whereby the gas flow (17) from the arc chamber (14) is limited.

Then, the arc current is decreased depending upon the commercial frequency, the high pressure gas in the arc chamber (14) is discharged from the opening (19) to cool the arc (15).

Thus, the narrow passage (16) is formed between the nozzle (13) and the insulator (6) mounted on the one end of the movable contact (1) as shown in FIG. 3(*c*) and the arc (15) is limited to pass through the narrow passage. That is, the arc (15) is formed as the arc in the narrow passage (16) and the arc in the puffing operation which are connected in series. Accordingly, the desirable designs for the narrow passage and the puffing passage can be given to result advantageous effects as the same with the former embodiment.

As described above, in accordance with the present invention, the gas interrupter comprises the cylindrical fixed contact; the movable contact; the insulator mounted on the end of the movable contactor; a nozzle or a flow guide made of insulation material around the mounted insulator and the movable contact, whereby the arc in the narrow passage formed between the insulator and the flow guide or between the insulator and the nozzle, is formed with the arc in the puffing in series. Accordingly, the interrupting characteristic can be improved by the simple structure which is economically manufactured.

What is claimed as new and desired to be secured by letters patent of the United States is:

1. A gas interrupter comprising:

a container adapted to hold an interrupting gas;

first and second electrical terminals in said container;

a hollow fixed contact electrically connected to said first terminal;

an insulating nozzle fixed to said first terminal, said nozzle surrounding said fixed contact and forming an arc chamber adjacent said fixed contact, said arc chamber terminating in a hollow narrowed portion at a point opposite said fixed contact;

an elongated movable contact electrically connected to said second terminal, said movable contact having an insulating material mounted on one end and being smaller than said hollow narrowed portion by a finite amount, said movable contact being normally located with said one end electrically connected to said fixed contact and with the remainder of said movable contact passing through said arc chamber and said narrowed portion, said arc chamber having a constant volume and communicating with said container only through the hollow part of said fixed contact and said narrowed portion; and means for moving said movable contact away from said fixed contact and out of said arc chamber so that one end passes through said narrowed portion with a narrow space therebetween.

* * * * *